US007201708B2

(12) United States Patent
Dreissigacker et al.

(10) Patent No.: US 7,201,708 B2
(45) **Date of Patent: *Apr. 10, 2007**

(54) MACHINE-ASSISTED EXERCISING

(75) Inventors: Richard A. Dreissigacker, Morrisville, VT (US); Peter D. Dreissigacker, Stowe, VT (US); Jonathan V. Williams, Waterbury Center, VT (US)

(73) Assignee: Concept II, Inc., Morrisville, VT (US)

( * ) Notice: Subject to any disclaimer, the term of this patent is extended or adjusted under 35 U.S.C. 154(b) by 664 days.

This patent is subject to a terminal disclaimer.

(21) Appl. No.: 09/790,432

(22) Filed: Feb. 21, 2001

(65) Prior Publication Data

US 2001/0008861 A1 Jul. 19, 2001

Related U.S. Application Data

(63) Continuation of application No. 09/329,915, filed on Jun. 10, 1999, now Pat. No. 6,561,955.

(51) Int. Cl.
*A63B 69/06* (2006.01)

(52) U.S. Cl. ..... 482/72; 482/111

(58) Field of Classification Search ..... 482/51–53, 482/56–59, 63, 72, 73, 111–113
See application file for complete search history.

(56) References Cited

U.S. PATENT DOCUMENTS

| | | | | |
|---|---|---|---|---|
| 1,950,896 A | | 3/1934 | Luzzi | 272/72 |
| 1,974,445 A | | 9/1934 | Calleson | 272/72 |
| 2,069,454 A | | 2/1937 | Lofquist et al. | 208/70 |
| 2,725,231 A | | 11/1955 | Hoover | 272/72 |
| 3,472,508 A | | 10/1969 | Baker et al. | 272/57 |
| 3,558,130 A | | 1/1971 | Anderson | 272/72 |
| 3,586,322 A | | 6/1971 | Kverneland | 272/72 |
| 3,657,926 A | | 4/1972 | Munson et al. | 73/404 |
| 3,859,840 A | | 1/1975 | Gause | 73/1 |
| 3,962,914 A | | 6/1976 | Lutz | 73/125 |
| 3,967,503 A | | 7/1976 | Svensson | 73/379 |
| 4,082,264 A | * | 4/1978 | Santos | 482/59 |
| 4,141,248 A | | 2/1979 | Bargenda | 73/379 |
| 4,249,725 A | | 2/1981 | Mattox | 272/117 |
| 4,346,886 A | | 8/1982 | Cox et al. | 272/72 |
| 4,396,188 A | | 8/1983 | Dressigacker et al. | 272/72 |

(Continued)

FOREIGN PATENT DOCUMENTS

CA 1177502 11/1984

(Continued)

OTHER PUBLICATIONS

Concept II Model C Rowing Ergometer *Assembly and Use Manual*, 1993.

(Continued)

*Primary Examiner*—Jerome Donnelly
*Assistant Examiner*—Tam Nguyen
(74) *Attorney, Agent, or Firm*—Fish & Richardson P.C.

(57) ABSTRACT

An exercise machine in which a fan has a rotor that generates drag by causing air to move in response to exercising by a user. A deflection structure deflects air that the rotor has moved and is adjustable to control the amount of drag generated by the rotor.

14 Claims, 9 Drawing Sheets

U.S. PATENT DOCUMENTS

| | | | | |
|---|---|---|---|---|
| 4,537,396 | A * | 8/1985 | Hooper | 482/8 |
| 4,589,656 | A * | 5/1986 | Baldwin | 482/59 |
| 4,674,741 | A | 6/1987 | Pasierb, Jr. et al. | 272/72 |
| 4,743,011 | A | 5/1988 | Coffey | |
| 4,800,513 | A | 1/1989 | Deutsch | 364/571.02 |
| 4,875,674 | A | 10/1989 | Dreissigacker et al. | 272/72 |
| 4,880,224 | A | 11/1989 | Jonas et al. | 272/72 |
| 4,884,800 | A | 12/1989 | Duke | 272/72 |
| 4,997,181 | A | 3/1991 | Lo | 272/72 |
| 5,013,033 | A | 5/1991 | Watterson et al. | 272/72 |
| 5,072,929 | A | 12/1991 | Peterson et al. | 272/72 |
| 5,094,446 | A | 3/1992 | Wiedner | 272/72 |
| 5,110,118 | A | 5/1992 | Winey | 482/73 |
| 5,147,265 | A | 9/1992 | Pauls et al. | 482/119 |
| 5,328,422 | A | 7/1994 | Nichols | 482/52 |
| 5,354,253 | A | 10/1994 | Awbrey et al. | 482/111 |
| 5,374,228 | A | 12/1994 | Buisman et al. | 482/71 |
| 5,492,516 | A | 2/1996 | Trotter | 482/57 |
| 5,511,740 | A | 4/1996 | Loubert et al. | 242/381 |
| 5,514,053 | A | 5/1996 | Hawkins et al. | 482/63 |
| 5,762,584 | A | 6/1998 | Daniels | 482/75 |
| 6,488,611 | B1 * | 12/2002 | Ambrosina et al. | 482/63 |
| 6,561,955 | B1 * | 5/2003 | Dreissigacker et al. | 482/57 |

FOREIGN PATENT DOCUMENTS

| | | |
|---|---|---|
| EP | 0203804 A2 | 5/1986 |
| WO | WO 00/76592 | 12/2000 |

OTHER PUBLICATIONS

Arndt et al., *Gyrating-Mass Test Rig for Hoisting Gear Brakes*, Monthly Technical Review, vol. 16, No. 11, Nov. 1972.

Lambert, *Get Ready, Set, Suffer*, Sports Illustrated, Apr. 20, 1987.

Concept II Model C Rowing Ergometer brochure, 1993.

The Concept II Rowing Ergometer brochure, 1990.

Wind Racer Brochure, Heart Mate, Ingelwood, CA, earlier than 1998.

* cited by examiner

MACHINE-ASSISTED EXERCISING

This is a continuation of application Ser. No. 09/329,915, filed Jun. 10, 1999, now U.S. Pat. No. 6,561,955.

BACKGROUND

This invention relates to machine-assisted exercising.

Exercising is frequently done with the help of an exercise machine that resists motion of the exerciser's arms or legs.

Some machines, such as rowing machines and cycling machines, resistive forces that are small enough to permit aerobic exercising over a longer period of, say, 20 to 40 minutes.

Other machines, such as weight machines, offer higher resistive forces for so-called resistance exercising that entails fewer repetitions.

Some exercise machines use wind drag created by a fan to provide the resistance.

SUMMARY

In general, in one aspect, the invention features an exercise machine in which a fan has a rotor that generates drag by causing air to move in response to exercising by a user. A deflection structure deflects air that the rotor has moved and is adjustable to control the amount of drag generated by the rotor.

Implementations of the invention may include one or more of the following features. The rotor moves and the deflection structure remains stationary. The deflection structure has deflection surfaces, e.g., curved vanes, at least one of which is adjustable relative to the path of air that the rotor has moved. Each of the deflection surfaces is independently rotatable from an open position to a closed position.

The deflection structure and the rotor are located at different positions along an axis of the rotor. An air directing surface is positioned to deflect air from the deflection structure toward the fan rotor. A closed housing surrounds the rotor and the deflection structure.

In general, in another aspect of the invention an outer dimension of the fan rotor and in inner dimension of the housing define a cylindrical chamber, and the fan rotor vanes direct air from inside the rotor to the cylindrical chamber and cause swirling of the air in the chamber.

In general, in another aspect, the invention features an exercise machine that has a fan that generates drag by causing air motion, a beam, a carriage, and a seat. The carriage rides back and forth along the beam and is coupled to drive the fan in response to force applied by a user exercising. The fan is driven when the carriage is riding in one direction along the beam and is undriven when the carriage is riding in the other direction along the beam. A seat is configured to be movable to different positions along the beam relative to the carriage and to different orientations relative to the carriage.

Among the advantages of the invention may be one or more of the following. The wind resistance provided by the fan may be adjusted to provide different exercise experiences. Different exercise modes may be achieved by rearranging the seat relative to the moving carriage, adjusting the seat angle, and adjusting the handle height. In the case of strength training, wind resistance eliminates the need for hundreds of pounds of weight. The force experienced by the user is determined by the user effort. This means the muscles can be appropriately stressed through the entire range of motion. With commonly used weight-lifting equipment, the muscles may be stressed at the proper level only at the place in the exercise motion where the muscles are the weakest.

Other advantages and features will become apparent from the following description and from the claims.

DESCRIPTION

Figure 1:
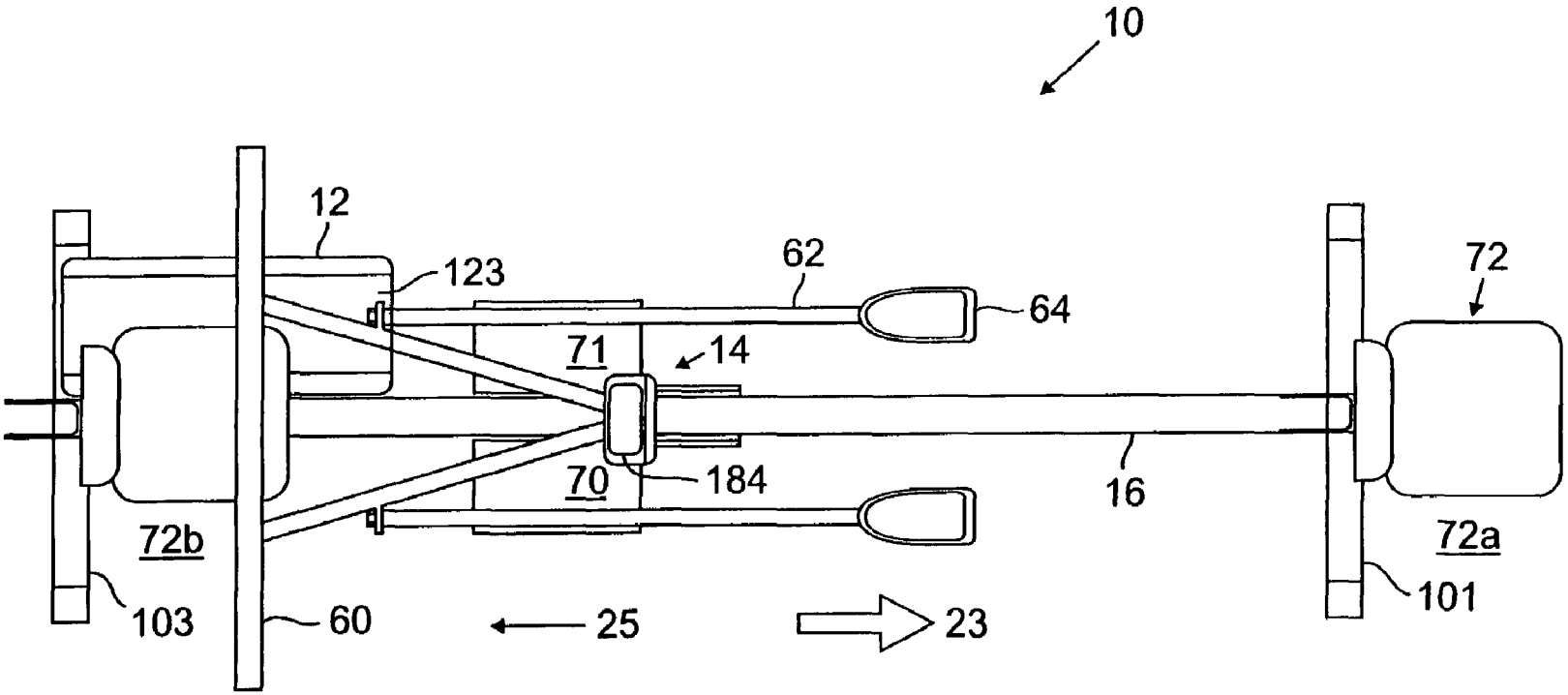
FIGS. 1 and 2 are top and side views, respectively, of an exercise machine.
Figure 2:
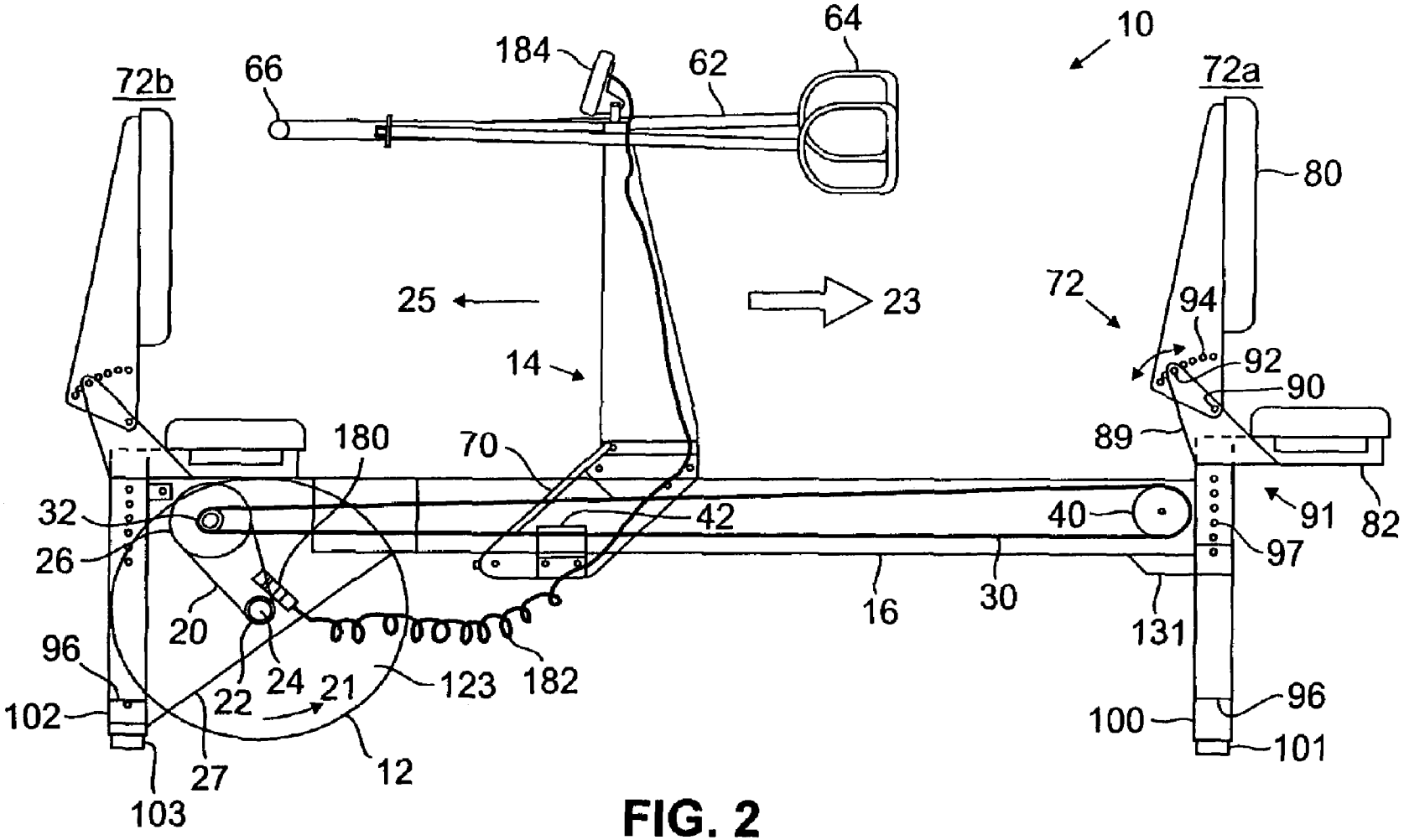

As seen in FIGS. 1 and 2, in an exercise machine 10, a wind-generating fan 12 imposes a selectable amount of resistive force as a carriage 14 is pushed or pulled along a beam 16 by a user (not shown).

The wind-generating fan 12 is driven by motion of the carriage through a system of chain loops and pulleys. One chain loop 20 connects a pulley 22, which is mounted between the fan's axle 24, to a larger pulley 26, which is mounted on a pair of brackets 27 (only one shown) at one end of the beam 16. A second chain loop 30 connects a smaller pulley 32, which is mounted on the same axle as pulley 26, to a free wheeling pulley 40 mounted at the other end of the beam. A bracket 42, which is attached to the carriage 14, also grips the second chain loop 30.

As the carriage is forced back and forth along the beam, the second chain loop drives pulley 26, and pulley 32 in turn drives pulley 22. A one-way clutch on the axle of the fan (not shown in FIGS. 1 and 2 but seen in FIG. 3) permits pulley 22 to drive the fan in direction 21 when the carriage is moving in a driving direction 23 along the beam. When driven, the fan spins, generating air resistance in a manner described below. The air resistance is converted to a force that resists linear motion of the carriage and enables a user to exercise by pushing or pulling on the carriage.

The one-way clutch allows the fan to freewheel when the carriage is moving in a coasting direction 25 along the beam. The user may return the carriage to its original position in the coasting direction with little effort and then may repeat the cycle for repetitive exercise.

The relationship between the linear velocity of the carriage and the rotational velocity of the fan, and the corresponding relationship between the air resistance generated by the fan and the linear resistance on the carriage, are determined by the sizes of the pulleys. The sizes are chosen to provide an appropriate exercise experience.

The carriage is configured to enable the user to apply force by pushing or pulling through his arms and hands or by pushing his legs and feet, or by doing both. In other possible configurations, the user's legs and feet could be pulled to move the carriage.

A handle bar 60 is mounted on the carriage to permit pushing or pulling by hand. A pair of rigid straps 62 with hand stirrups 64 are attached to the handle bar to permit pulling by hand. The handle bar may be adjustably mounted so that the height may be set to suit the user and the type of exercise. Footrests 70, 71 on either side of the carriage permit pushing with the feet.

A seat 72 (the seat is shown twice in FIG. 1, in two different positions, one position 72*a* for pulling, the other position 72*b* for pushing), includes a vertical seat back 80 and a horizontal seat bottom 82.

In the pulling position 72*a*, the seat bottom is on the other side of the seat back from the carriage. In that position, the user sits on the seat bottom facing the carriage and his chest is supported against the vertical face of the seat back as he pulls.

In the pushing position 72*b*, the seat bottom is on the same side of the seat back from the carriage. In that position, the user sits on the seat bottom facing the carriage and his back is supported by the seat back as he pushes.

Other seat positions would also be possible such as one in which the user sits at the pull end and faces away from the carriage.

The seat back is mounted to the seat bottom through a bracket 89 that supports the seat back on one pivoting support 90 and a second adjustable support 92 that cooperates with a series of holes 94 on the seat back to permit the angle of the back to be adjusted.

The seat bottom 82 and the bracket 89 are part of a seat base 91 that also includes a square steel post 96, which is held within one or the other of two square steel legs 100, 102 located at opposite ends of the beam. The post 96 has a vertical column of holes 97 that cooperate with one or more holes in the sides of the beam legs to permit the height of the seat to be adjusted using pins.

The leg 100 on the pull end of the exercise machine has a foot 101 at its bottom end that rests on the floor. The leg 102 on the push end of the exercise machine has a foot 103 at its bottom end that also rests on the floor. The pull end leg 100 has a bracket 131 that is connected to and supports the bottom of the beam at the pull end. The push end leg 102 supports the push end of the beam indirectly on brackets 27.

Figure 3:
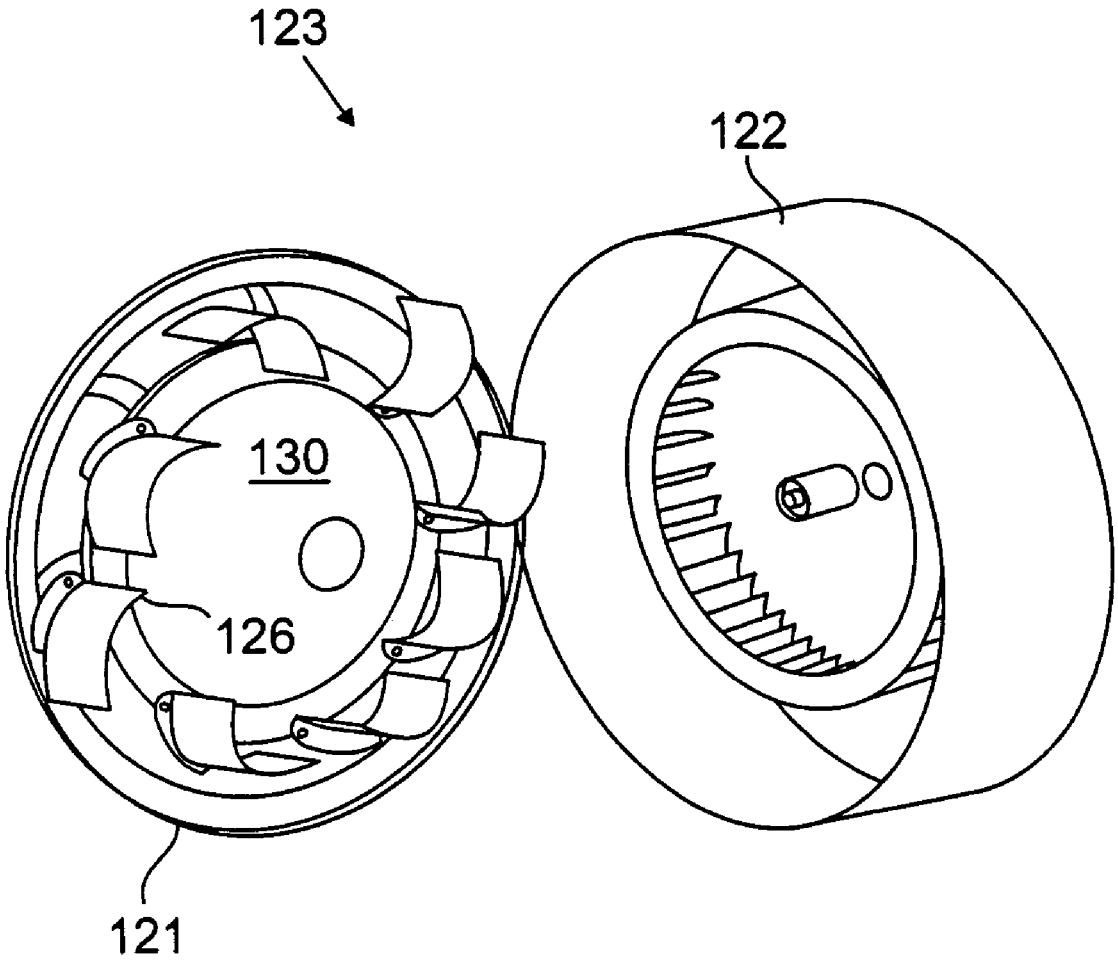
FIG. 3 is a perspective view of an opened fan canister.
Figure 4:
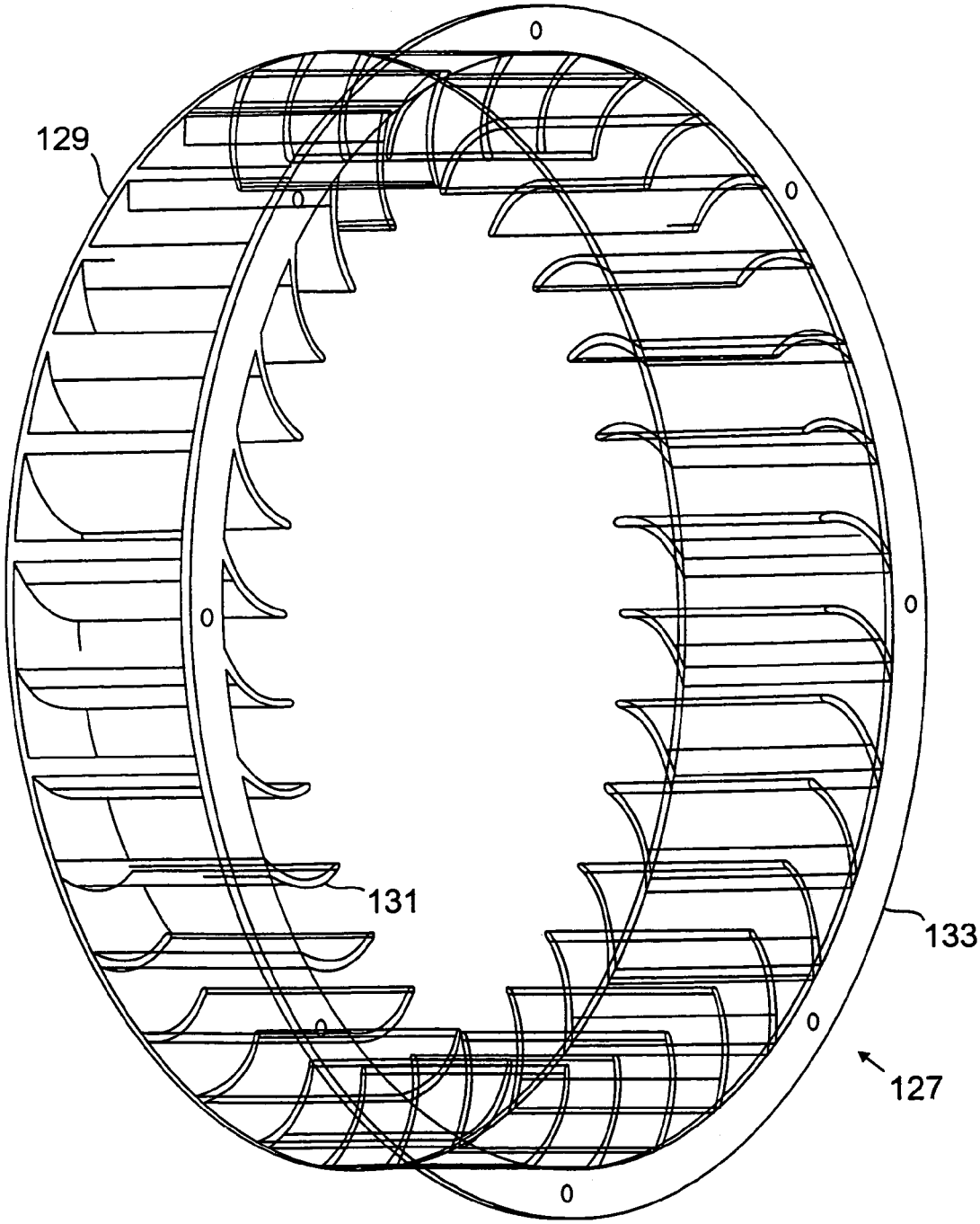
FIGS. 4 and 5 are a wire frame perspective view and an end view, respectively, of a fan rotor.
Figure 5:
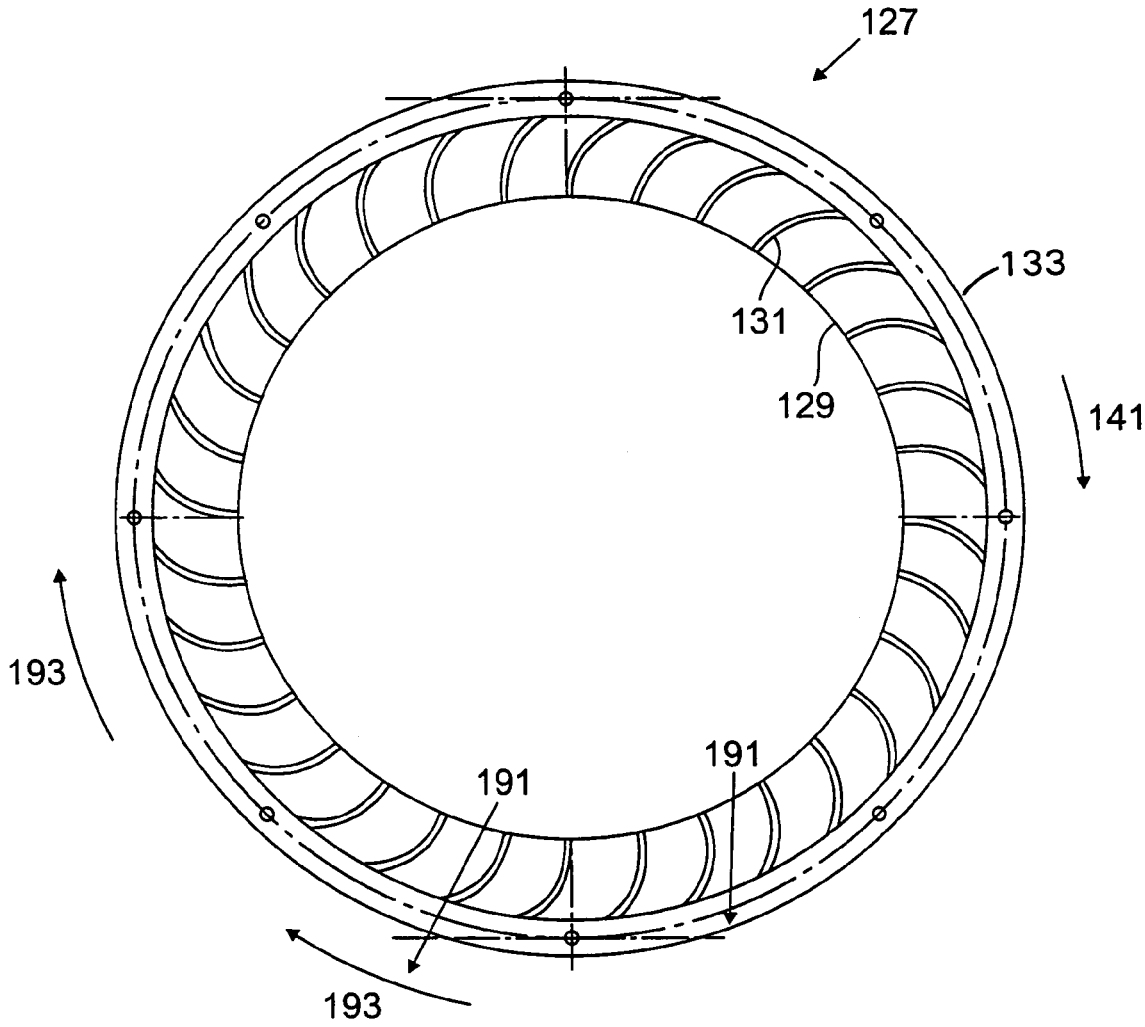

As seen in FIG. 3, the fan 12 includes a closed canister 123 (shown open in FIG. 3) comprising a cylindrical housing 122 and a lid 124. As also seen in FIGS. 4 and 5, the fan includes a rotor 127 having a cylindrical cage 129 with a number (e.g., 32) of curved fan blades 131 arranged with equal spacing around the axis of the cage. The rotor has a flange 133 to permit the rotor to be mounted on a rotating disk. The rotating disk is attached to a hub which contains the clutch and bearings. The outer diameter of the rotor could be, for example, 14 inches, and the inner diameter of the cage housing 122 could be, for example, 18 inches, leaving a cylindrical open chamber (184 in FIG. 8) about 2 inches thick for circulation of air. When the rotor is being driven by motion of the carriage, it rotates in direction 141 shown in FIG. 5.

Referring again to FIG. 3, the lid supports a set of (e.g., eight) adjustable vanes 126 arranged in a circle at equal spacing around the axis of the lid to form a stator that interacts with the rotor through air flow within the canister to generate air drag. The stator also includes a bowl-shaped air deflector 130 mounted on the lid inside the ring of vanes.

Figure 6:
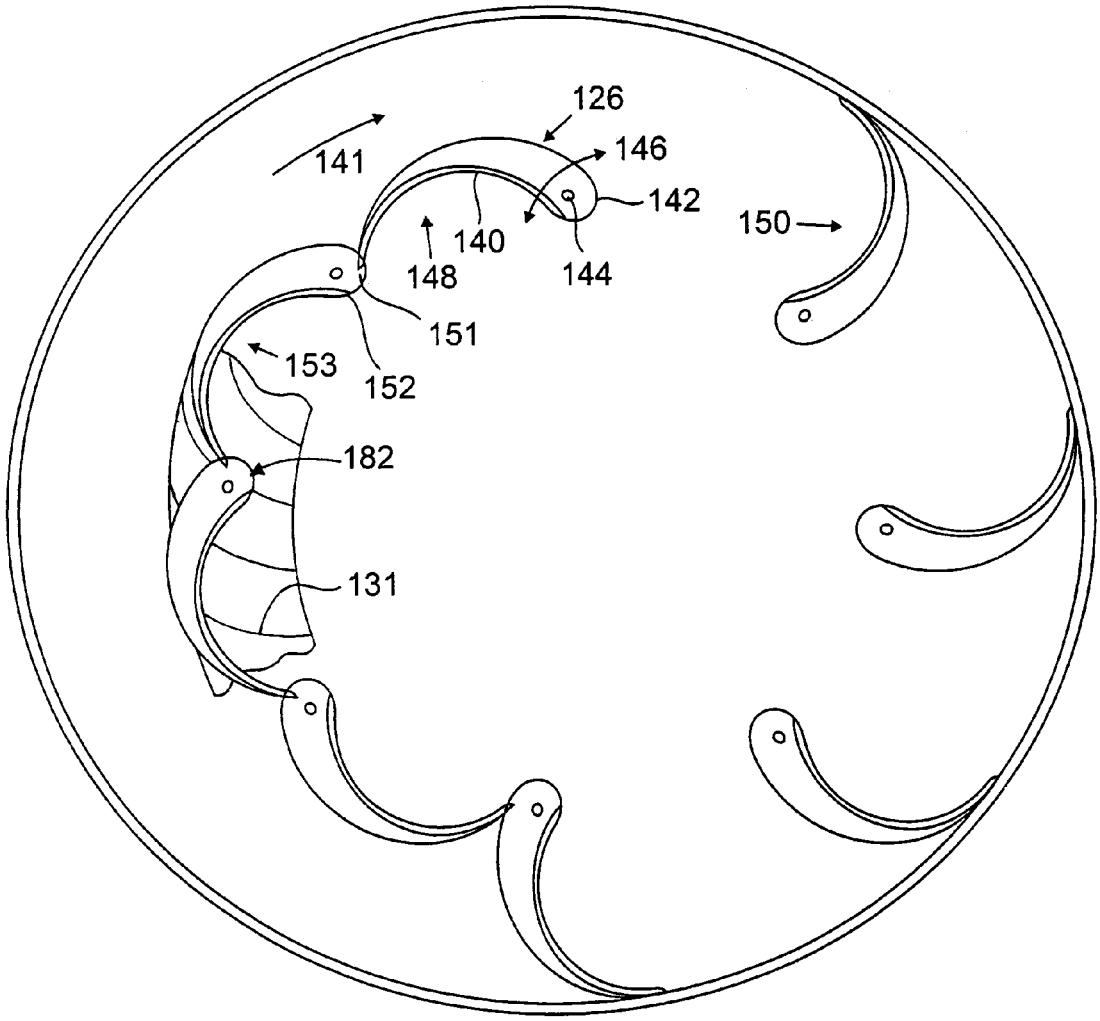
FIG. 6 is a partial end view of stator vanes.

As seen in FIG. 6, each vane 126 has an air deflection surface 140 in the shape of a section of a cylinder and a base 142, which supports the air deflection surface. The base has a hole 144 that permits mounting the vane on the lid by a fitting 145 (FIG. 7) that allows the vane to be rotated 146 around the fitting.

Figure 7:
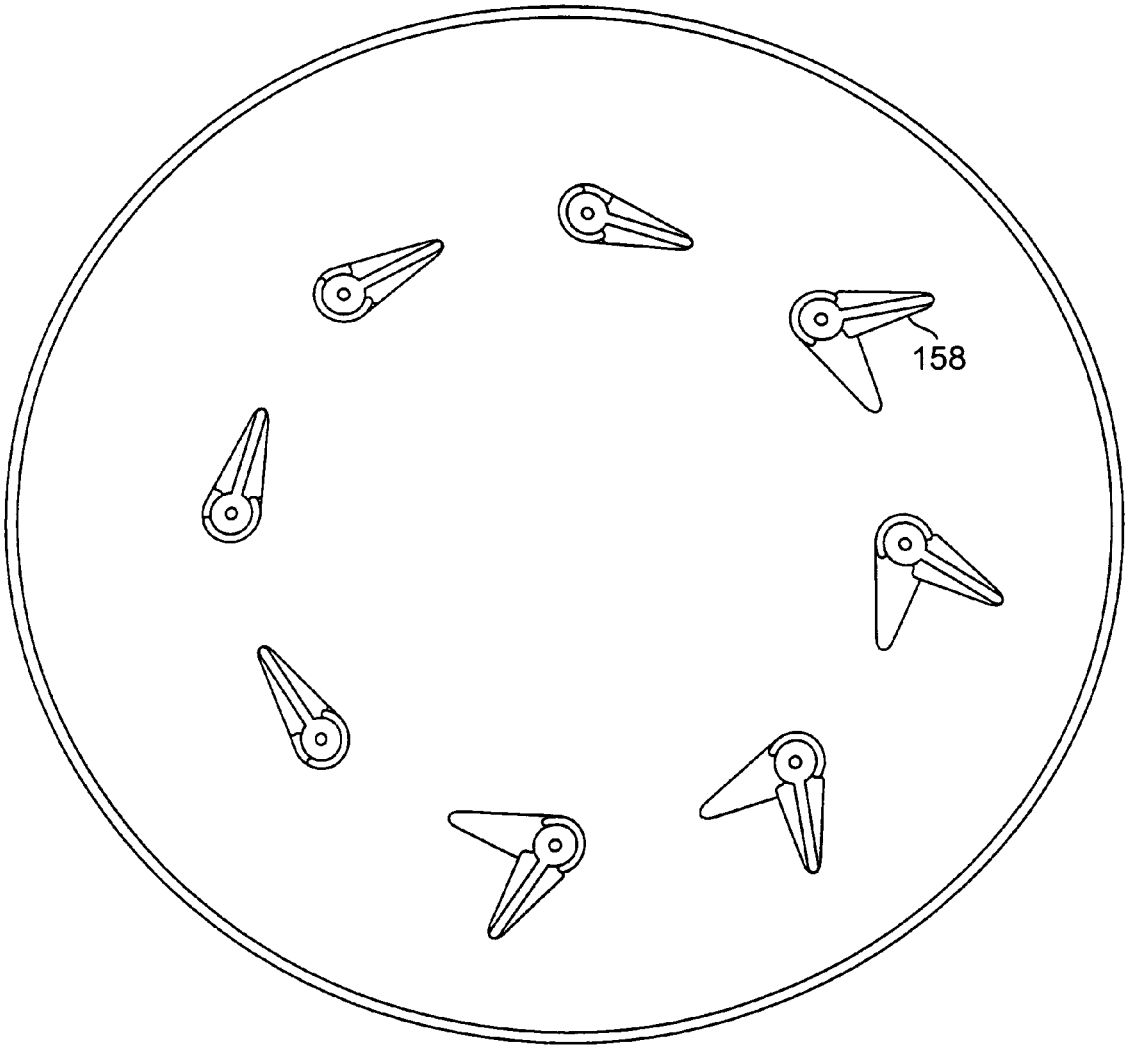
FIG. 7 is a perspective view of a fan canister viewed from the lid end.

As seen in FIG. 7, on the outside of the lid, each vane has a positioning lever 158 that allows a user to turn the vane to a desired angular position to control the amount of air resistance generated by the fan.

The vane fitting 145 resists rotation so that the user can adjust the vane by hand, and the vane will not shift from its adjusted position until adjusted again.

Referring again to FIG. 6, each vane can be adjusted from a fully closed position 148 to a fully open position 150. In the fully closed position, the tip 151 of the vane almost touches the other end 152 of the next vane 153 of the ring. In the fully open position, the tip of the vane touches the inner wall of the canister housing when the canister is closed.

Figure 8:
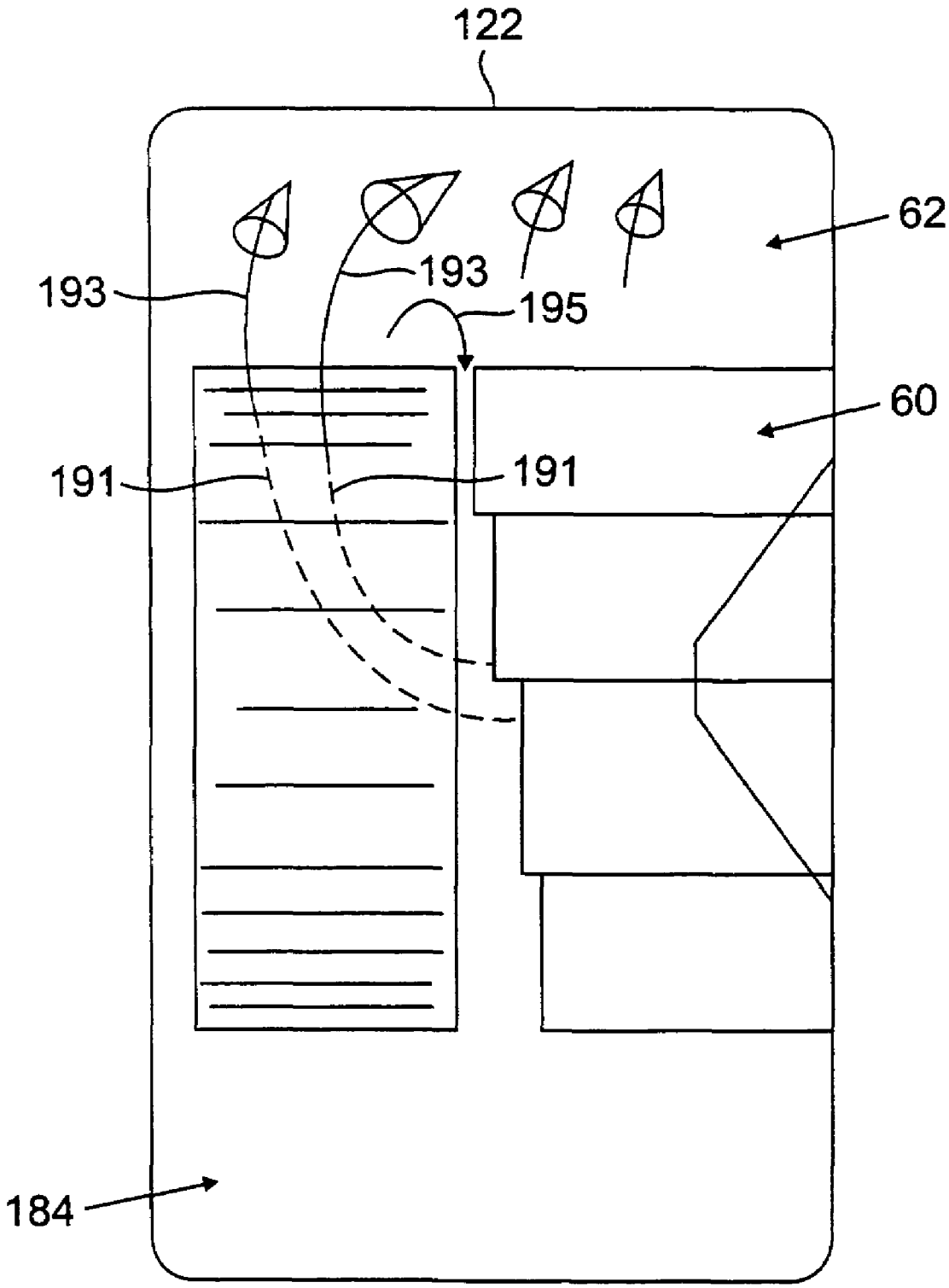
FIGS. 8 and 9 are schematic views of airflow inside the fan canister.
Figure 9:
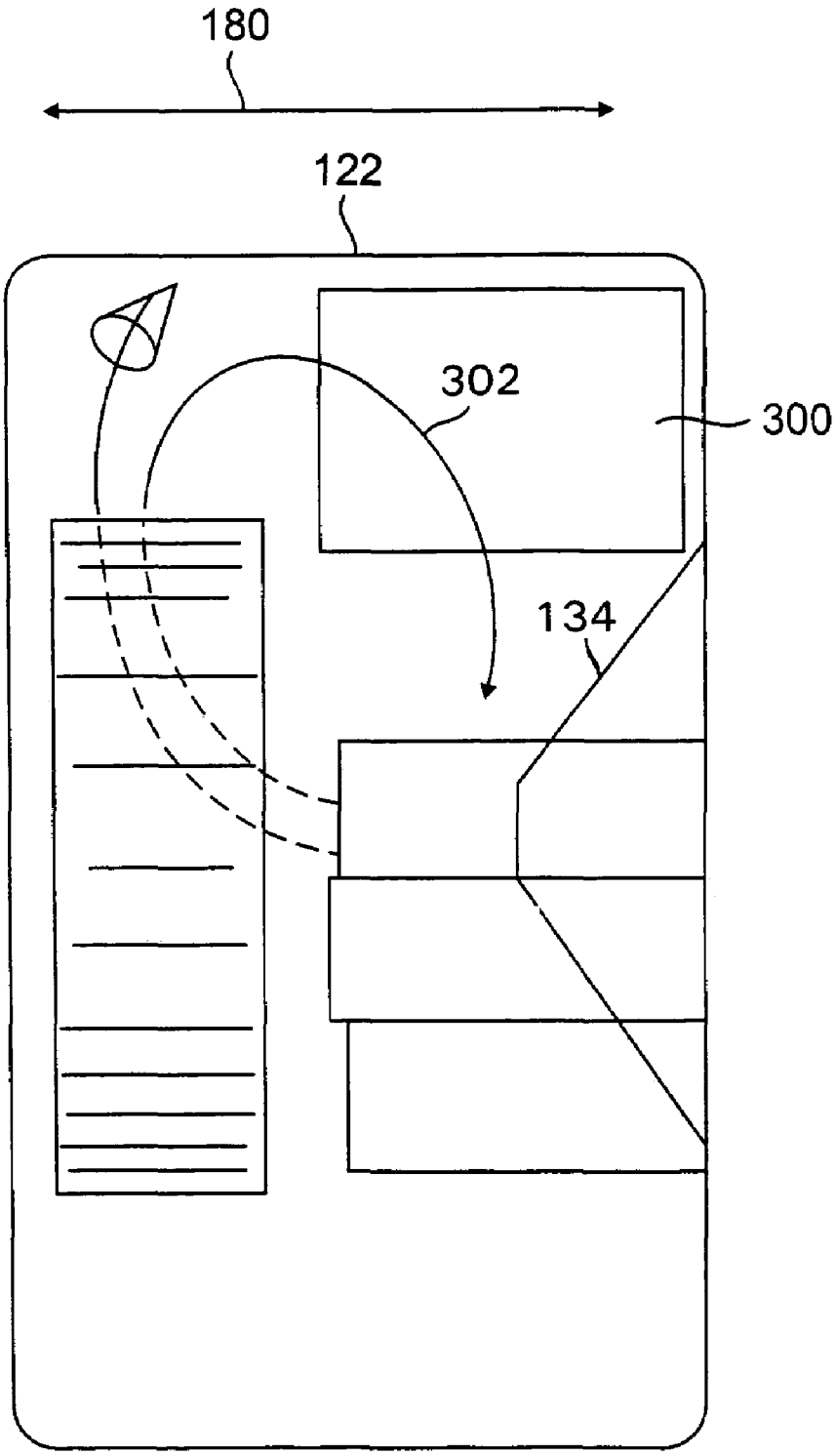

As shown in FIGS. 8 and 9, the housing 122 is deeper 180 than the height of the rotor. The remaining space accommodates the stator when the canister is closed. The stator is about the same height as the rotor.

The vanes of the stator can be adjusted between two extreme configurations. At one extreme, shown in FIG. 8, all stator vanes are turned to the closed positions. This effectively divides the outer end of the canister into two chambers, a round central chamber 60 surrounded by a cylindrical outer chamber 62, with only a small amount of leakage (182 in FIG. 6) allowing air to flow between them. The outer chamber 62 is essentially an extension of the chamber that surrounds the rotor.

In the other extreme configuration, all vanes are open. The tips of all of the vanes touch the inner wall of the canister, effectively eliminating the outer cylindrical chamber 62.

Although the exact details of the airflow within the canister are not known, it is believed that the following considerations apply.

Because of the one-direction clutch on the axle of the rotor, the rotor can only rotate in the direction 141 in FIG. 5, in which the curved vanes act as scoops to pick up air from the space within the rotor and direct it (arrows 191) to the cylindrical chamber outside of the rotor. This motion tends to set up a whirl of air 193 that rotates around the outer chambers of the canister in the same direction in which the rotor is rotating.

As seen in FIG. 8, when the stator vanes are in the fully closed configuration, the cylindrical chamber that surrounds the stator is in line with the donut shaped chamber that surrounds the rotor. Only a small proportion of the air leaks back 195 into the chamber within the rotor, where it is again thrown out into the donut-shaped chambers. Because there is relatively less re-circulation of the air within the canister the amount of drag resistance imparted to the user is also relatively less.

Conversely, when the stator vanes are in the fully open configuration, the air flow from the rotor is constantly striking the deflection surfaces of the stator vanes (shown, as to one stator 300, in FIG. 9) and is being redirected 302 into the central part of the canister where it can be re-circulated by the fan. The redirection of the air is aided by the surface 134 of the air deflector 130. As seen in FIG. 6, the vanes of the stator are oriented to have the opposite curvature of the vanes 131 of the moving rotor 127.

Because there is relatively more re-circulation of the air than in the fully closed case, the amount of drag resistance is also relatively greater.

By adjusting one or more of the vanes, a range of configurations between the two extremes can be set, such as the one shown in FIG. 9. Because each vane can be adjusted to any position between open and closed, virtually any desired resistance level between those achieved by the two extreme configurations can be obtained.

In any of the stator configurations, the faster the fan is rotated, the more drag is created. A so-called drag factor accounts for changing conditions of the fan including airflow to the fan and air density. As explained, the configuration of the stator vanes alters the airflow to the fan. When all stator vanes are closed the drag for a given rotational speed will be lowest. Opening each stator vane will increase the drag by a factor of about 45%. With all stator vanes open, the drag factor is about 20 times greater than when all are closed. The large range of drag factor makes the exercise machine useful for a variety of strength training exercises.

Referring again to FIG. 1, a magnetic sensor 180 is attached to the fan canister to measure the speed of the fan. A cable 182 carries the information to a display 184, which is mounted in a position where the user can see it easily. The monitor displays exercise performance values such as force, time, speed, work, power and repetition information. These values are based on the principles described in U.S. Pat. No. 4,875,674, incorporated by reference. Other embodiments are within the scope of the following claims. For example, other configurations of exercise positions, beams, and carriages can be used.

The invention claimed is:

1. An exercise machine comprising:

a fan rotor configured to generate drag by causing air to move in response to exercising by a user;

a housing configured to enclose the fan rotor so that the drag is generated substantially only by motion of air within the housing;

a deflection structure within the housing comprising curved vanes; and each vane having a positioning lever configured to allow the user to control the amount of drag generated by adjustably positioning at least one vane wherein each vane comprises a curved deflection surface having a shape of a section of a cylinder and a base disposed on a surface of the housing on a plane transverse to the deflection surface.

2. The exercise machine of claim 1 wherein the positioning levers are on an exterior portion of the housing.

3. The exercise machine of claim 1 wherein each positioning lever is connected to a vane by a fitting.

4. The exercise machine of claim 3 wherein the fittings resist rotation.

5. The exercise machine of claim 1 wherein the base comprises a first side and a second side and a passage extending from the first side of the base to the second side of the base.

6. An exercise machine comprising:

a fan rotor configured to generate drag by causing air to move in response to exercising by a user;

a housing configured to enclose the fan rotor so that the drag is generated substantially only by motion of air within the housing;

a deflection structure within the housing comprising vanes;

the deflection structure and the rotor being located at different positions along an axis of the rotor; and each vane having a positioning lever configured to allow the user to control the amount of drag generated by adjustably positioning at least one vane wherein each vane comprises a curved deflection surface having a shape of a section of a cylinder and a base disposed on a surface of the housing on a plane transverse to the deflection surface.

7. The exercise machine of claim 6 wherein the positioning levers are on an exterior portion of the housing.

8. The exercise machine of claim 6 wherein each positioning lever is connected to a vane by a fitting.

9. The exercise machine of claim 6 wherein the fittings resist rotation.

10. The exercise machine of claim 6 wherein the base comprises a first side and a second side and a passage extending from the first side of the base to the second side of the base.

11. An exercise machine comprising:

a support, a driving mechanism configured to move relative to the support as a user exercises, a fan having:

a rotor configured to generate drag by causing air to move in response to motion of the driving mechanism as the user exercises, the air moving between a location upstream and a downstream location of the rotor;

a deflection structure configured to deflect air that has been moved to the downstream location by the rotor; and an air directing surface positioned to further deflect air, which has been deflected by the deflection structure, along a path from the deflection structure toward the location upstream of the fan rotor;

a housing that encloses the fan rotor so that the drag is generated substantially only by motion of air within the housing; and an outer dimension of the fan rotor an inner dimension of the housing define a cylindrical chamber wherein the fan rotor have vanes that direct air from inside the rotor to the cylindrical chamber and cause swirling of the air in the chamber.

12. An exercise machine comprising:

a fan that generates drag by causing air motion, a support, a driving mechanism configured to ride back and forth along the support and comprising a handgrip, the driving mechanism being coupled to drive the fan in response to force applied to the handgrip by a user exercising, the fan being driven when the driving mechanism is riding in one direction along the support and being undriven when the driving mechanism is riding in the other direction along the support, and a seat disposed along the support wherein the seat is configured to be movable to different positions along the support relative to the driving mechanism and different orientations relative to the driving mechanism.

13. A method comprising:

enabling a user to cause motion of a driving mechanism along a support of an exercise machine, generating drag in response to exercising by a user by rotating a rotor in response to motion of the driving mechanism, the rotor being disposed in a closed housing about an axis of rotation, thereby causing the air within the closed housing to move;

deflecting air that has been moved by the rotor using a deflection structure comprising a curved vanes;

adjusting the deflection of the air within the closed housing to control the magnitude of drag generated by altering the position of the curved vanes relative to the air moving perpendicular to the rotor's axis; and converting the drag into force that resists the user's exercising.

14. The method of claim 13 further comprising directing deflected air toward the rotor.

* * * * *